US008031840B2

(12) United States Patent
Thran et al.

(10) Patent No.: US 8,031,840 B2
(45) Date of Patent: Oct. 4, 2011

(54) BEAM FILTER, PARTICULARLY FOR X-RAYS

(75) Inventors: Axel Thran, Hamburg (DE); Jens-Peter Schlomka, Hamburg (DE)

(73) Assignee: Koninklijke Philips Electronics N.V. (NL)

( * ) Notice: Subject to any disclaimer, the term of this patent is extended or adjusted under 35 U.S.C. 154(b) by 56 days.

(21) Appl. No.: 12/517,262

(22) PCT Filed: Nov. 30, 2007

(86) PCT No.: PCT/IB2007/054865

§ 371 (c)(1), (2), (4) Date: Jun. 2, 2009

(87) PCT Pub. No.: WO2008/068690

PCT Pub. Date: Jun. 12, 2008

(65) Prior Publication Data

US 2010/0074393 A1 Mar. 25, 2010

(30) Foreign Application Priority Data

Dec. 4, 2006 (EP) ..... 06125335

(51) Int. Cl.
*G21K 3/00* (2006.01)

(52) U.S. Cl. ..... 378/156

(58) Field of Classification Search ..... 378/156–159
See application file for complete search history.

(56) References Cited

U.S. PATENT DOCUMENTS

| | | | |
|---|---|---|---|
| 5,394,453 | A | 2/1995 | Harding |
| 6,157,703 | A | 12/2000 | Solomon et al. |
| 6,862,340 | B2 | 3/2005 | Wurzer |
| 2005/0089136 | A1 | 4/2005 | Toth et al. |

FOREIGN PATENT DOCUMENTS

| | | | |
|---|---|---|---|
| DE | 4222227 | A1 | 1/1994 |
| DE | 9017465 | U1 | 6/2009 |
| EP | 1045398 | A2 | 10/2000 |
| EP | 1182671 | A2 | 2/2002 |
| EP | 1498908 | A2 | 1/2005 |
| WO | 0180252 | A1 | 10/2001 |
| WO | 2005087106 | A1 | 9/2005 |
| WO | WO 2005/087106 | * | 9/2005 |

* cited by examiner

*Primary Examiner* — Courtney Thomas

(57) ABSTRACT

The invention relates to a beam filter (10) that can particularly be used in spectral CT-applications for producing a desired intensity profile of a radiation beam without changing its spectral composition. In a preferred embodiment, the beam filter (10) comprises a stack of absorbing sheets (111) that are separated by wedge-shaped spaces (112) and focused to a radiation source (1). Furthermore, the absorbing sheets have a varying width in direct ion of the radiation. Different fractions of the radiation source (1) area are therefore masked by the beam filter (10) at different points (A, B) on a detector area (2). The absorbing sheets preferably comprise a material that is highly absorbing for the radiation to be filtered.

20 Claims, 4 Drawing Sheets

BEAM FILTER, PARTICULARLY FOR X-RAYS

The invention relates to a beam filter for insertion between a radiation source and a detection area. Moreover, it relates to an X-ray device comprising such a beam filter.

The U.S. Pat. No. 6,157,703 describes an X-ray filter realized as a copper or beryllium plate with a matrix of apertures. The apertures can selectively be shifted between positions of alignment or misalignment with respect to the holes of a collimator. In the case of a misalignment, the metal of the plate in front of the collimator holes attenuates an X-ray beam and removes particularly low-energy photons, thus "hardening" the spectrum of the beam.

Based on this situation it was an object of the present invention to provide filtering means that can particularly be used in devices with spectrally resolved detection.

This objective is achieved by a beam filter according to claim 1 and an X-ray device according to claim 10. Preferred embodiments are disclosed in the dependent claims.

The beam filter according to the present invention is designed for insertion between a radiation source and a detection area, wherein the radiation source may particularly be an X-ray source. Moreover, the radiation source shall have some spatial extension such that it cannot be approximated by a point source. It typically comprises a comparatively small radiation emitting area, for example the anode surface of an X-ray tube. The "detection area" may just be a virtual geometrical object, though it will typically correspond to the sensitive area of some detector device. The beam filter comprises at least one (first) absorbing body that masks in its working position (i.e. when being disposed between the radiation source and the detection area) different fractions of the radiation emitting area of the radiation source at different points on the detection area. This means that there are at least two points on the detection area from which the (spatially extended!) radiation source is seen partially masked by the absorbing body and for which the fraction of the masked source area is different.

The described beam filter has the advantage that different points on the detection area will be reached by different intensities of the radiation that is emitted by the radiation source because these points lie in half-shades of different degrees. The intensity distribution in the detection area can therefore precisely be adapted to the requirements of a particular application. If a patient shall for example be X-rayed, more intensity can be supplied to central regions of the patient's body than to peripheral regions.

In general, the absorbing body of the beam filter may have some transmittance for the radiation emitted by the radiation source such that its masking is not total. In a preferred embodiment of the invention, the absorbing body comprises however a material that is highly absorbing over the whole spectrum of the radiation emitted by the radiation source. Said material may particularly comprise materials with a high (mean) atomic number Z like molybdenum (Mo) or tungsten (W), which have a high absorption coefficient for X-rays. Other suited materials are gold (Au), lead (Pb), platinum (Pt), tantalum (Ta) and rhenium (Re). The absorbing body may consist completely or only partially of one of the mentioned materials, and it may of course also comprise a mixture (alloy) of several or all of these materials. The use of highly absorbing materials implies that masked points of the radiation source will not shine through but actually remain dark. The intensity of radiation reaching a point on the detection area will then (approximately) only be determined by the geometry of the absorbing body, which can very precisely be adjusted. A further advantage is that the intensity reduction at some point of the detector area will not imply a modification of the spectrum of the radiation, because the complete spectrum is blended out for the masked zones of the radiation source while the complete spectrum passes unaffectedly for the unmasked zones. This intensity adjustment without spectral modification is particularly useful in spectral CT applications that require a known, definite spectrum of the source radiation for a unique interpretation of the measurements.

In a preferred embodiment of the invention, the beam filter comprises a plurality of absorbing bodies that mask in their working position different fractions of the radiation source area at different points of the detection area. Moreover, these absorbing bodies are preferably shaped as absorbing sheets and arranged in a stack, wherein intermediate spaces separate neighboring sheets. Such a stack of absorbing sheets behaves similar to a jalousie with a plurality of lamellae that mask or conceal a light source. The absorbing sheets are preferably flat, though they may in general also assume other three-dimensional shapes.

The aforementioned intermediate spaces between neighboring absorbing sheets of the stack are preferably filled with a spacer material like a polymer, particularly a solid polymer, a foamed polymer, or a polymer glue. The spacer material provides stability and definite dimensions for the whole stack and allows to handle it as a compact block. The spacer material should have an attenuation coefficient for the radiation of the radiation source that is significantly lower than the attenuation coefficient of the material of the absorbing sheets. The attenuation coefficient of the spacer may for example be smaller than about 5%, preferably smaller than about 1% of the attenuation coefficient of the absorbing sheets for (the whole spectrum of) the radiation emitted by the radiation source.

In another preferred embodiment of the beam filter with absorbing sheets, the sheets lie in planes that intersect in at least one common point. If the radiation source is arranged such that it comprises said intersection point, the emitted radiation will propagate substantially in the direction of the planes. The radiation will therefore impinge onto the absorbing sheets parallel to the sheet plane, which guarantees a high absorption efficiency. It should be noted that if the planes are exactly planar and intersect in two common points, they will inevitably intersect in a complete line.

In a further development of the aforementioned embodiment, at least one absorbing sheet has a varying width, wherein said width is measured in radial direction with respect to a given point. Said point is preferably a common intersection point of the planes in which the absorbing sheets lie, because this guarantees that a ray starting at the point will impinge onto the complete width of the corresponding absorbing sheet in its plane.

In the aforementioned case, the varying width of the absorbing sheet preferably assumes a minimal value in a central region of the absorbing sheet. As will be explained with reference to the Figures, this will result in an intensity peak in a central region of the radiation passing through the beam filter, which is favorable for example in CT applications.

The absorbing sheets optionally have a varying thickness, wherein the thickness may vary between different points on the same absorbing sheet as well as between points on different absorbing sheets. The thickness of the absorbing sheets is a further parameter that can be tuned to establish a desired intensity profile across the detection area.

In a further development of the invention, the beam filter comprises a second absorbing body that is movable relative to the first mentioned absorbing body and that is arranged in line with the latter as seen in a direction from the radiation source to the detection area. The first and second absorbing bodies therefore have to be passed consecutively by light rays emitted by the radiation source. As the absorbing bodies can be moved with respect to each other, it is possible to selectively change the overlap between zones of the radiation source that are masked by the first and the second absorbing body, respectively, which in turn changes the overall masking degree. Thus the intensity distribution across the detection area can be changed comparatively simple by moving the second absorbing body with respect to the first absorbing body.

The invention further relates to an X-ray device, particularly in the form of a Computed Tomography (CT) scanner, that comprises a radiation source and a beam filter of the kind described above. As was already explained, the beam filter can establish practically any desired intensity profile in an associated detection area with minimal or even no changes to the spectrum of the radiation source. This is especially useful for spectral CT scanners as they require that the radiation passing through an X-rayed object has a known, definite spectrum.

These and other aspects of the invention will be apparent from and elucidated with reference to the embodiment(s) described hereinafter. These embodiments will be described by way of example with the help of the accompanying drawings in which.

Like reference numbers or numbers differing by integer multiples of 100 refer in the Figures to identical or similar components.

Beam filters according to the present invention will in the following be described with respect to an application in X-ray devices, particularly in spectral CT scanners, though the invention is not restricted thereto and can favorably be applied in connection with other kinds of electromagnetic radiation, too.

Spectral CT is a very promising technology which allows the discrimination of different elements in the body. In general, spectral CT is based on the fact that chemical elements show a distinct difference in the energy-dependence of the attenuation coefficient. In order to measure this energy dependence, some sort of energy discrimination is required on the detector side. Furthermore, the primary spectrum of radiation entering an object to be imaged has to cover a broad range of energies. One important part of spectral CT is the measurement of the photo-absorption contribution to the attenuation coefficient, which relies on the detection of rather low-energy photons.

For dose reduction purposes in contemporary CT scanners, so-called "bow-tie" filters can be used to adjust the photon flux along the fan direction to the shape of a patient, i.e. the larger thickness of the patient in the center requires a higher intensity there, while less intensity suffices for the decreasing thickness at the periphery of the body. Such a filter may be realized by a varying thickness of a light metal like Aluminum. The disadvantage of this approach for spectral CT is however that the filter will change the spectral shape of the primary radiation along the fan direction. Particularly the low-energy photons, which are of high importance for the measurement of the photo-absorption, are attenuated. As a consequence, this will reduce the possibility of spectral deconvolution in the edge regime of the fan, where the bow-tie filter exhibits its maximum thickness.

Due to these reasons there is a need for an alternative beam filter that allows to control the intensity profile of an X-ray beam, particularly a fan shaped beam, with minimal or ideally no modification of the radiation spectrum.

Figure 1:
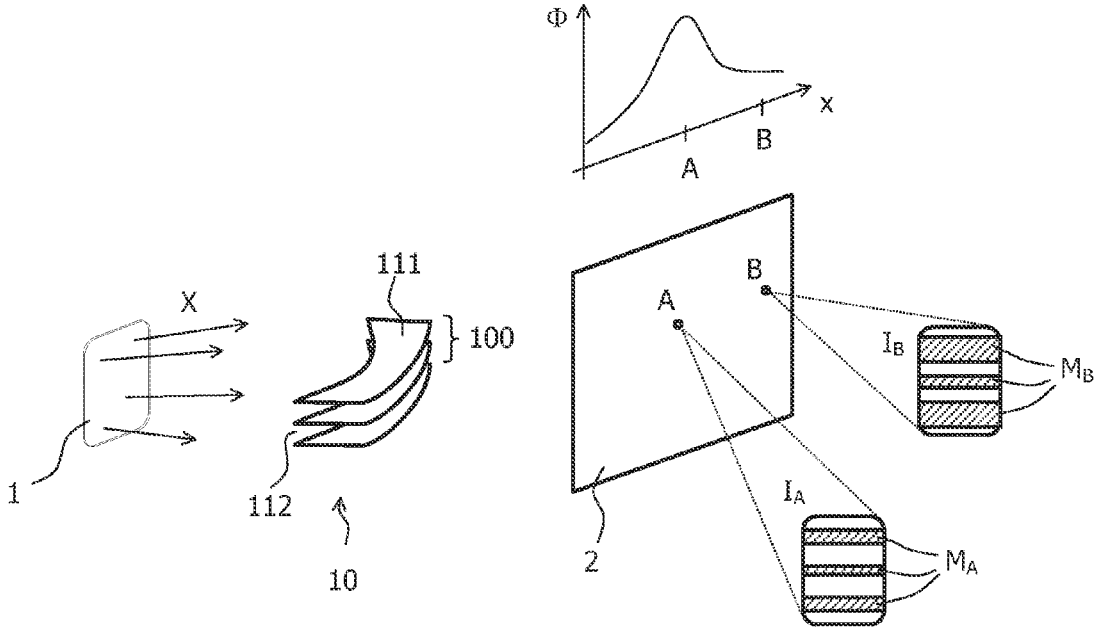
FIG. 1 shows in a perspective schematically an X-ray device with a beam filter according to the present invention.

To achieve the aforementioned objective, it is proposed here to use one or more absorbing bodies that mask or conceal the radiation source to different degrees as seen from different points of the detection area. FIG. 1 illustrates the principal setup, which comprises a beam filter 10 located between a spatially extended X-ray source 1 (e.g. the anode area of an X-ray tube) and a detector area 2 (e.g. the scintillator material or direct conversion material of a digital X-ray detector). The beam filter 10 comprises a stack 100 of absorbing sheets 111 that are separated by intermediate spaces 112. X-rays X emitted by the radiation source 1 will have to pass through the beam filter 10 before they can reach the detector area 2. Some of these rays will pass freely through the intermediate spaces 112 while others impinge on the absorbing sheets 111, where they are substantially completely absorbed. The attenuation of the X-ray beam is therefore realized by a "partial total absorption" of the radiation ("partial" with respect to the whole set of rays of the beam, "total" with respect to single absorbed rays), wherein the attenuated radiation basically preserves its initial spectral configuration.

FIG. 1 illustrates this filtering principle by showing enlarged sketches of the images $I_A$ and $I_B$ with which the area of the radiation source 1 is seen from a central point A and a peripheral point B on the detection area 2, respectively. Due to the particular shape of the absorbing sheets 111, the zones $M_A$ in which the radiation source 1 is masked in the central image $I_A$ have a smaller total area than the zones $M_B$ in which the radiation source 1 is masked in the peripheral image $I_B$. Consequently, the central point A will be illuminated with a higher beam intensity than the peripheral point B, as illustrated above the detection area in the profile of the intensity $\Phi$ along a line x through points A and B (it should be noted that the intensity profile will be balanced again if an object with a central thickness maximum, e.g. a patient, is placed between the beam filter 10 and the detection area 2). As the total radiation at the points A and B is composed in an all-or-nothing manner only of radiation that freely passed the beam filter 10 (and not or at least to only a minimal degree of radiation that passed an absorbing sheet), the spectral composition of the total radiation arriving at points A and B remains approximately the same.

Figure 2:
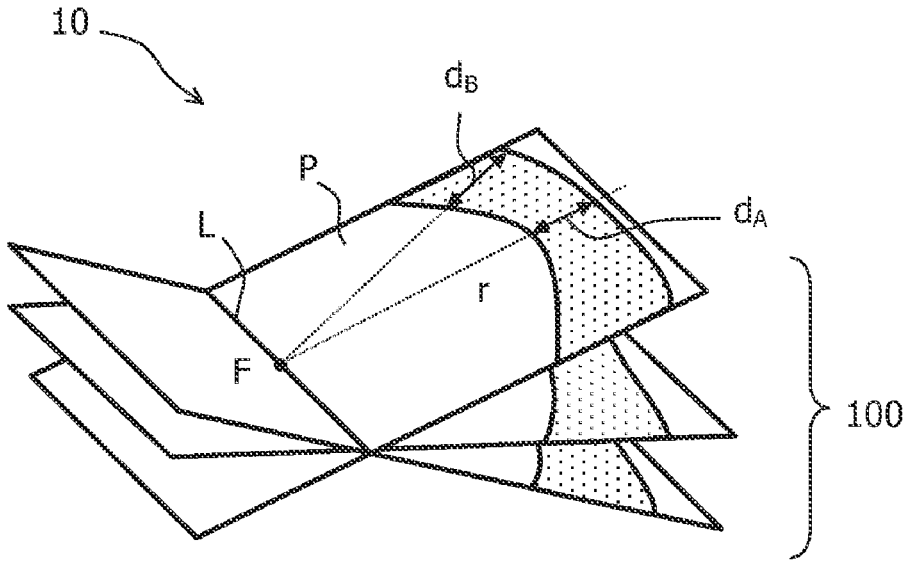
FIG. 2 illustrates the geometry of a first embodiment of a beam filter with one stack of absorbing sheets.

FIG. 2 illustrates the principal geometry of a first embodiment of a beam filter 10 according to the present invention. This beam filter 10 consists of a stack 100 of absorbing sheets 111 of substantially the same shape, wherein said shape corresponds to a quadrilateral in which two opposite sides are bent with different bending radius (wherein the bending radius of the convex side is larger than that of the concave side). Each of the flat absorbing sheets 111 lies in a plain P, wherein all these planes P intersect in a common line L and therefore also in a common "focal point" F (lying also on the symmetry line of the absorbing sheets 111).

When the beam filter 10 is applied for example in an X-ray device like that of FIG. 1, the radiation source 1 is located such that it comprises the aforementioned focal point F.

Radiation emitted by the source 1 will then propagate approximately radially from the focal point F (not exactly for all rays, as the radiation source 1 is not a mathematical point but has some finite extension). An important aspect of the beam filter 10 is that the width of its absorbing sheets 111 as measures along radii r originating at the focal spot F is variable. As can best be seen in the top view of the stack 100 of absorbing sheets 111 shown in FIG. 3, this width assumes a maximal value $d_B$ at the periphery of the absorbing sheets 111 and declines continuously towards the centre of the absorbing sheets 111, where it assumes its minimal value $d_A$.

Figure 3:
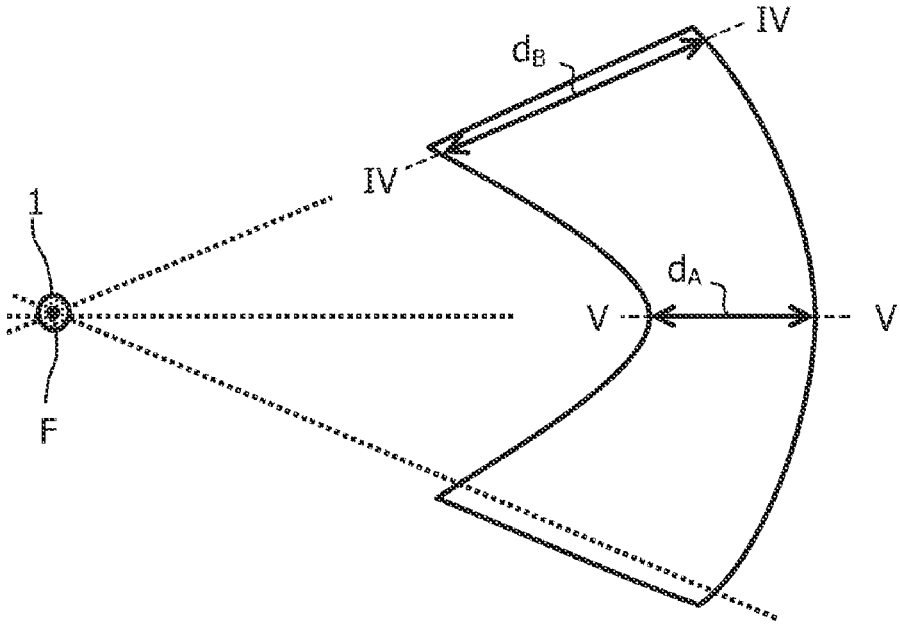
FIG. 3 shows a top view of the beam filter of FIG. 2.
Figure 4:
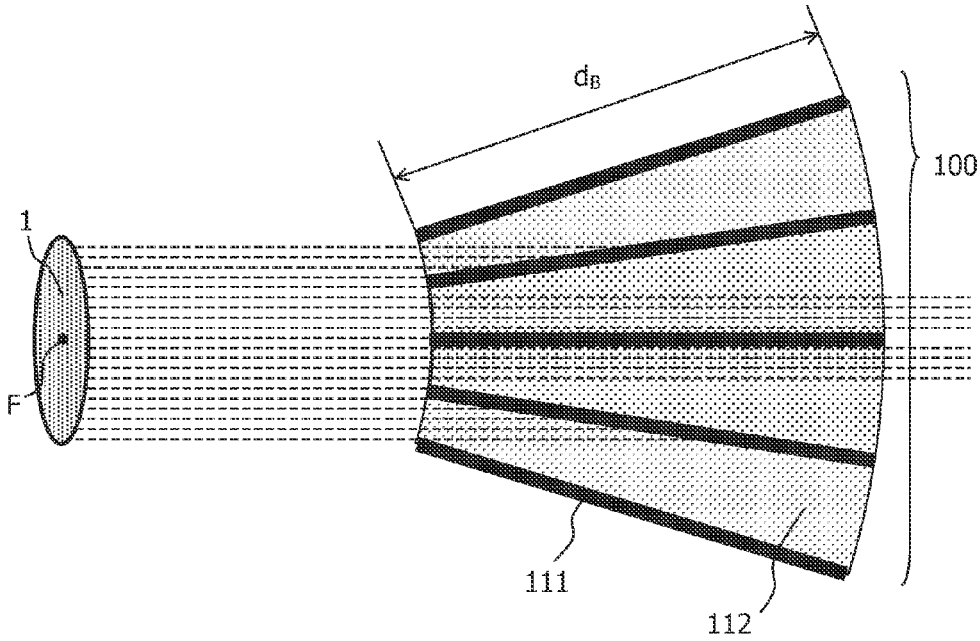
FIG. 4 shows a section along the line IV-IV of FIG. 3.
Figure 5:
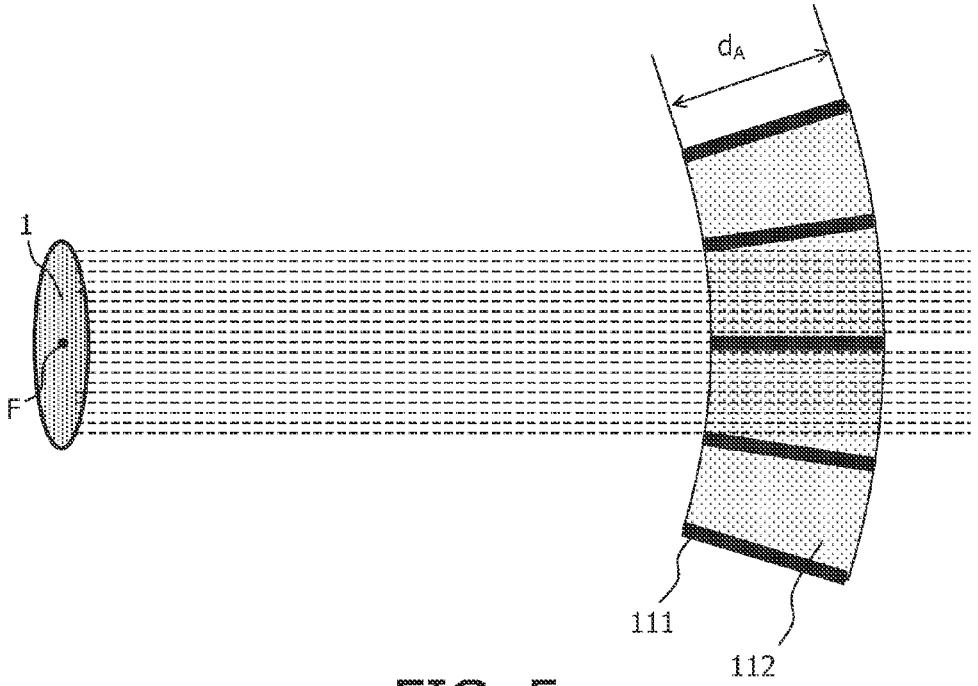
FIG. 5 shows a section along the line V-V of FIG. 3.

FIGS. 4 and 5 show sections along the lines IV-IV and V-V, respectively, of FIG. 3. It can be seen that the beam filter 10 comprises a stack 100 of (in the example five) absorbing sheets 111 separated by (four) intermediate spacers 112 that are transparent for X-radiation and that may consist for example of a polymethacrylimide hard foam material (commercially available under the name Rohacell® from Degussa, Germany). The absorbing sheets 111 typically consist of a highly absorbing material, for example molybdenum or tungsten. Moreover, the absorbing sheets are focused towards the X-radiation source 1 due to their arrangement in planes P (FIG. 2). As the Figures illustrate particularly for X-rays that propagate parallel to the central symmetry axis of the setup, a larger fraction of the radiation emitted by the radiation source 1 is absorbed in the peripheral part of the beam filter 10 where the absorbing sheets 111 have a high width $d_B$ than in the central part where the absorbing sheets 111 have a short width $d_A$.

The described design of the beam filter 10 can be modified in various ways, for example by:

- changing the thickness (measured perpendicular to the sheet plane) of the highly absorbing sheets 111 relative to the thickness of the spacer sheets 112,
- tilting the whole stack 100,
- a suitable deformation of the absorbing sheets 111.

Figure 6:
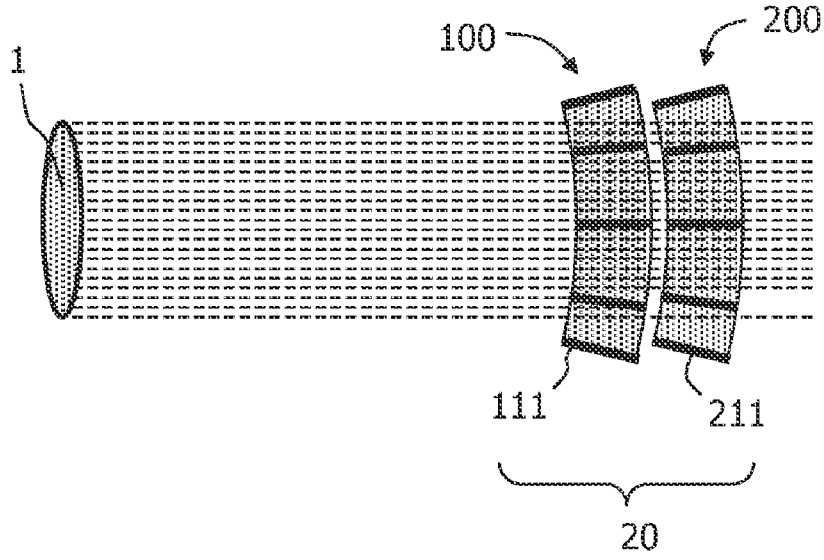
FIG. 6 shows a second embodiment of a beam filter in a representation like that of FIGS. 4 and 5, said beam filter comprising two stacks of absorbing sheets.
Figure 7:
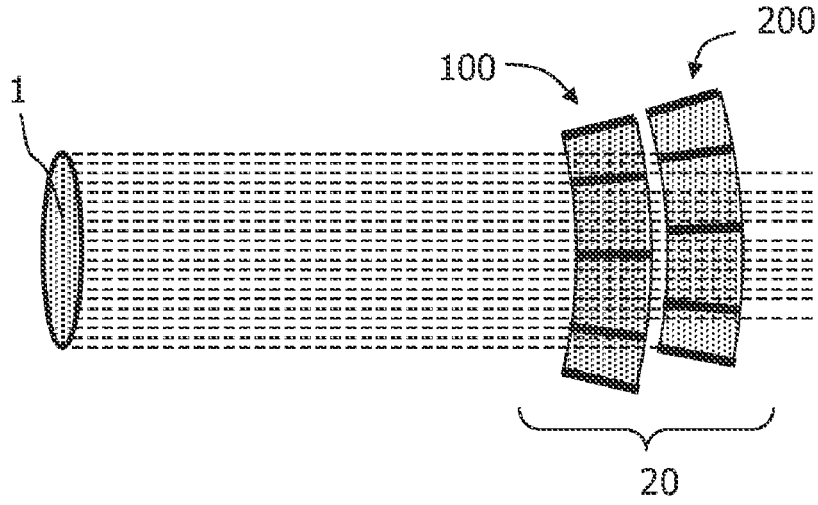
FIG. 7 shows the beam filter of FIG. 6 when the stacks of absorbing sheets are shifted relative to each other.

FIGS. 6 and 7 illustrate a second design of a beam filter 20 with adjustable absorbing properties, said beam filter 20 consisting of two stacks 100, 200 of absorbing sheets 111 and 211, respectively, wherein each of these stacks has a design like the beam filter 10 described above. The two stacks 100, 200 of absorbing sheets 111, 211 are placed one behind the other in the direction of the X-ray propagation. X-rays will therefore have to pass both stacks 100, 200 before they can reach a detector. The area of the X-radiation source 1 that is masked by the absorbing sheets 111, 211 can be changed if the stacks 100, 200 are shifted with respect to each other. FIG. 6 shows in this respect an arrangement in which the absorbing sheets of the two stacks 100, 200 are aligned, while FIG. 7 shows an arrangement in which the second stack 200 is shifted somewhat with respect to the first stack 100, resulting in a reduced intensity of the beam at the output side.

In the described embodiments of a primary beam filter with a multi-layer structure, the spectral shape of the radiation is hardly changed as attenuation is realized by partial total absorption. The beam filters are favorably applicable in medical CT, particularly spectral CT.

Finally it is pointed out that in the present application the term "comprising" does not exclude other elements or steps, that "a" or "an" does not exclude a plurality, and that a single processor or other unit may fulfill the functions of several means. The invention resides in each and every novel characteristic feature and each and every combination of characteristic features. Moreover, reference signs in the claims shall not be construed as limiting their scope.

The invention claimed is:

1. A beam filter for insertion between a radiation source and a detection area, comprising at least one absorbing body that masks, in its working position, different fractions of a radiation emitting area of the radiation source at different points of the detection area, where the at least one absorbing body is comprised of a plurality of absorbing sheets, and where at least one of the plurality of absorbing sheets has a varying width as measured in radial directions with respect to a given point.

2. The beam filter according to claim 1, wherein the absorbing body comprises a material that is highly absorbing over the whole spectrum of radiation emitted by the radiation source preferable a material with a high atomic number, most preferably a material selected from the group consisting of Mo, W, Au, Pb, Pt, Ta and Re.

3. The beam filter according to claim 1, where the plurality of absorbing sheets are arranged with intermediate spaces in a stack.

4. The beam filter according to claim 3, wherein the intermediate spaces are filled with a spacer material which has a significantly lower attenuation coefficient for the radiation of the radiation source that the material of the absorbing sheets, particularly a polymer.

5. The beam filter according to claim 3, wherein the absorbing sheets lie in planes that intersect in a least one common point.

6. The beam filter according to claim 1, wherein the width assumes a minimal value in a central region of the absorbing sheet.

7. The beam filter according to claim 3, wherein the absorbing sheets have varying thicknesses.

8. The beam filter according to claim 1, wherein it comprises a second body that is movable relative to the first absorbing body and arranged in line with it as seen in a direction from the radiation source to the detection area.

9. An X-ray device, particularly a CT scanner, comprising a radiation source and a beam filter according to claim 1.

10. The beam filter of claim 3, where the stack is configured to be tiltable.

11. The beam filter of claim 1, comprising:

a second body that is movable relative to the first absorbing body and arranged out of line with the first body as seen in a direction from the radiation source to the detection area.

12. A beam filter for insertion between a radiation source and a detection area, comprising:

at least one absorbing body that masks, in its working position, different fractions of a radiation emitting area of the radiation source at different points of the detection area, where the at least one absorbing body is shaped as at least two absorbing sheets, where the at least two absorbing sheets are arranged with spaces in a stack, and where at least two of the at least two absorbing sheets vary in thickness relative to one another.

13. The beam filter of claim 12, comprising:

a second absorbing body that is movable relative to the first absorbing body and arranged in line with the first body as seen in a direction from the radiation source to the detection area.

14. The beam filter of claim 12, comprising:

a second absorbing body that is movable relative to the first absorbing body and arranged out of line with the first body as seen in a direction from the radiation source to the detection area.

15. The beam filter of claim 12, wherein the absorbing body comprises a material selected from the group consisting of Au, Pb, Pt, Ta and Re.

16. The beam filter of claim 12, comprising:

at least two absorbing bodies that are adjustable relative to one another to adjust an absorption property of the beam filter.

17. The beam filter of claim 12, where at least one absorbing sheet has a varying width as measured in radial directions with respect to a given point.

18. A system, comprising:

at least one absorbing body that masks, in its working position, different fractions of a radiation emitting area of a radiation source at different points of a detection area, where the at least one absorbing body causes a first point on the detection area to experience a first intensity level, where the at least one absorbing body causes a second point on the detection area to experience a second intensity level, where the first intensity level and the second intensity level are different, where the first point and the second point are on a line perpendicular to the radiation emitting area, where the radiation emitting area causes a non-zero intensity across a continuous portion of the detection area that includes the first point and the second point, and where the at least one absorbing body comprises:

a plurality of relatively high absorbing material sheets; and a plurality of relatively low absorbing material sheets; where the relatively high absorbing material sheets are stacked, are spaced apart from one another, and are separated by at least one sheet of the plurality of relatively low absorbing material sheets.

19. The system of claim 18, where at least one of the relatively high absorbing material sheets has a varying thickness among points on the relatively high absorbing material sheet.

20. The system of claim 18, where at least two of the relatively high absorbing material sheets have a varying thickness relative to one another.

* * * * *